US005216841A

United States Patent [19]

Piilonen

[11] Patent Number: 5,216,841

[45] Date of Patent: Jun. 8, 1993

[54] SHARPENING DEVICE FOR THE BLADES OF A CROSS-CUTTING ROLLER

[76] Inventor: Pentti Piilonen, Mämmenkylä, Äänekoski SF 44150, Finland

[21] Appl. No.: 664,540

[22] PCT Filed: Sep. 11, 1989

[86] PCT No.: PCT/FI89/00170

§ 371 Date: Mar. 4, 1991

§ 102(e) Date: Mar. 4, 1991

[87] PCT Pub. No.: WO90/02629

PCT Pub. Date: Mar. 22, 1990

[30] Foreign Application Priority Data

Sep. 16, 1988 [FI] Finland ..... 884263

[51] Int. Cl.[5] ..... B24B 19/00

[52] U.S. Cl. ..... 51/109 BS; 51/241 R; 51/241 S; 51/246

[58] Field of Search ..... 51/109 BS, 98 BS, 98 HK, 51/241 R, 241 S, 246, 285, 33 HK, 240 R, 240 A, 240 GB

[56] References Cited

U.S. PATENT DOCUMENTS 1,863,036 6/1932 Wike ..... 51/246

*Primary Examiner*—Bruce M. Kisliuk
*Assistant Examiner*—Eileen Morgan
*Attorney, Agent, or Firm*—Brooks & Kushman

[57] ABSTRACT

A sharpening device for the blade of a cross-cutting roller (1) is disclosed in which the cross-cutting roller (1) includes at least one blade plate (4) which is located in the angle formed by the two machined surfaces (2,3) of the cross-cutting roller in such a way that the original blade bevel (5) is outer and that the blade is sharpened by grinding the original bevel (5) of the blade plate (4) to form a less sharp bevel (6) at the edge of the blade plate (4), and in which the sharpening device includes support wheels (7,10), a grinding stone (8) and devices rotate it. The intention of the this invention is to achieve a new kind of sharpening device for the blades of cross-cutting rollers, which makes it possible to sharpen them without removing the blade plates. In accordance with the invention, at least one support wheel (7) is adapted to be supported on the original bevel (5) of the blade plate (4) and on the free side surface of the blade plate (4).

5 Claims, 4 Drawing Sheets

SHARPENING DEVICE FOR THE BLADES OF A CROSS-CUTTING ROLLER

TECHNICAL FIELD

This invention relates to a sharpening device for the blade of a cross-cutting roller.

BACKGROUND ART

In many cellulose plants, the cellulose-drying machine is a bottleneck in production, so that special attention is paid to its operation. In accordance with the present technique, the blades of the cross-cutting roller of the sheet cutter of the drying machine are changed every two months, sometimes even every two weeks if necessary. The blunt blades are generally sent to a suitable manufacturer for sharpening, after which they are returned to the plant. The removal of the blade sheets of the cross-cutting roller and their replacement with other blades causes a shutdown of about eight hours in the production of the entire plant. Naturally, attempts are made to fit this in with other breaks in production, but this does not always succeed, or the change of the blades prolongs shut-down from other causes.

Blades that have been removed can be sharpened for example in a sharpening device in accordance with U.S. Pat. No. 4,685,250. British patent publication GB-1432873 shows a sharpening device that is intended to sharpen the blades of cylinder rollers, in particular in grain and hay harvesters. A device of this kind requires the previous installation of suitable guides on the frame of the machine, in which the grinding device can move. Devices of this kind are difficult to adapt to suit the sheet cutter of a drying machine, because its width, 6–8 m, would lead to massive support structures.

German publication print 1159804 describes a sharpening device for the blade of a planing machine, in which the sharpening device is placed on top of the drum by means of sliding shoes located on both sides of the blade. A solution of this kind cannot be considered with long blades, because the surface of the drum is in any case so uneven that a good support cannot be obtained from it.

SUMMARY OF THE INVENTION

An object of the present invention is to provide a new kind of sharpening device for the blades of a cross-cutting roller, which makes it possible to sharpen them without the blade plates having to be removed.

Another object of the invention is to provide a sharpening device for the blade of a cross-cutting roller, which is located in the angle formed by the two machined surfaces of the cross-cutting roller in such a way that the original bevel of the blade is outer and that the blade is sharpened by grinding a less steep bevel than the original bevel on the point of the blade plate, and which sharpening device includes support wheels, a sharpening blade and devices to rotate it.

It is another object of the invention to provide a sharpening device to be used in connection with the cross-cutting roller of a sheet cutter in a cellulose-drying machine, that can also be adapted for sharpening a blade attached to any corresponding kind of roller, in which the sharpening takes in a corresponding manner. For example, the invention is suitable for sharpening the blades of the cross-cutting roller of a cardboard machine.

A more specific object of the invention is to provide a sharpening device for the blade with a cross-cutting roller in which the cross-cutting roller includes at least one blade plate which is placed in the angle form by the two machine surfaces of the cross-cutting roller in such a way that the original bevel is outer and that the blade is sharpened by grinding a less steep edge bevel than the original bevel of the blade plate. The sharpening device includes support wheels, a grinding stone and vices to rotate it and at least one support wheel is adapted to be supported on the original bevel of the blade plate and on the free side surface of the blade plate.

In a preferred embodiment of the invention, the sharpening device includes two support wheels that are supported on the original bevel of the blade plate and a side support wheel that is supported on the other machine surface of the cross-cutting roller which support wheel travels at a slight distance from the blade plate. An auxiliary wheel rests on the blade plate and a level apparatus for lifting the sharpening device onto the auxiliary wheel slightly upwards in order to raise the grinding stone and to lower it slowly against the edge bevel of the blade plate. Additionally, an extra blade plate can be added as an extension to the blade plate on which the sharpening device runs in order to let the grinding stone travel to the end of the blade plate proper.

The main principle of the invention is that the sharpening device is supported over the entire length of the blade plate by the original bevelled surface of the blade plate itself. Most advantageously, the device includes two support wheels, and at the side, a side support wheel resting on the machined surface of the cross-cutting roller, in which case the support of the grinding blade is extremely stable. Other forms of application and advantages of the invention become apparent in connection with the form of application presented later.

In what follows, the invention is illustrated with the aid of examples by reference to the accompanying illustrations, which show one form of application of the invention.

BEST MODE FOR CARRYING OUT THE INVENTION

Figure 1:
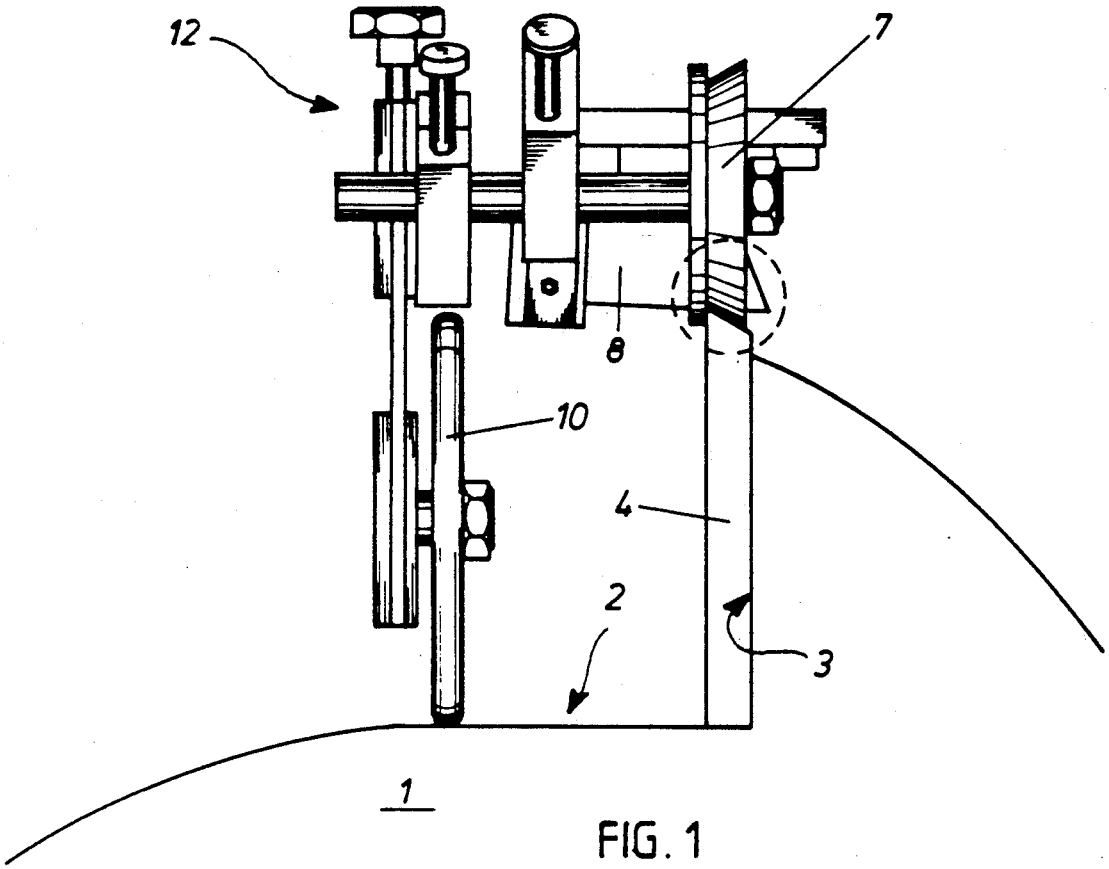
FIG. 1 is a front elevational view of a sharpening device constructed in accordance with the present invention illustrating a cross-cutting roller and blade plate.

The servicing of a cross-cutting roller is carried out during a suitable break in production. Because it is no longer necessary to remove the blade plates, it only takes about one hour to sharpen and adjust them. The covers of the cross-cutting roller are opened, so that access is gained to the blade plates themselves. The cross-cutting roller is turned until the blade plate 4, which is to be sharpened, is uppermost. The sharpening device is placed on top of the blade plate in accordance with FIG. 1. The cross-cutting roller 1 includes two machined surfaces 2 and 3, against which the blade plate 4 is placed. The sharpening device is placed on blade plate 4 by means of its support wheels 7 and on the other machined surface 2 by means of its support wheel 10.

Figure 2:
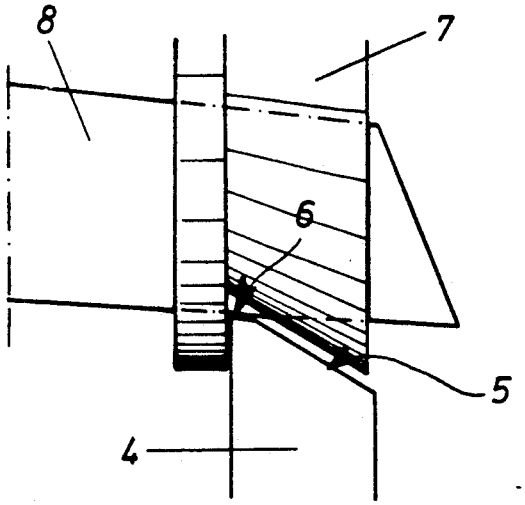
FIG. 2 is an enlarged sectional detail of the blade plate and a support wheel of FIG. 1.

FIG. 2 shows the blade geometry that makes the support system in accordance with the invention possible. The blade plate 4 has an original bevel 5 and the sharpening of the blade plate takes place by grinding a less steep bevel 6 onto the blade plate. The two support wheels 7 of the sharpening device support themselves on the original bevel surface 5 and on the free side surface. The sharpening of the blade plate is carried out by means of the grinding stone 8.

Figure 3:
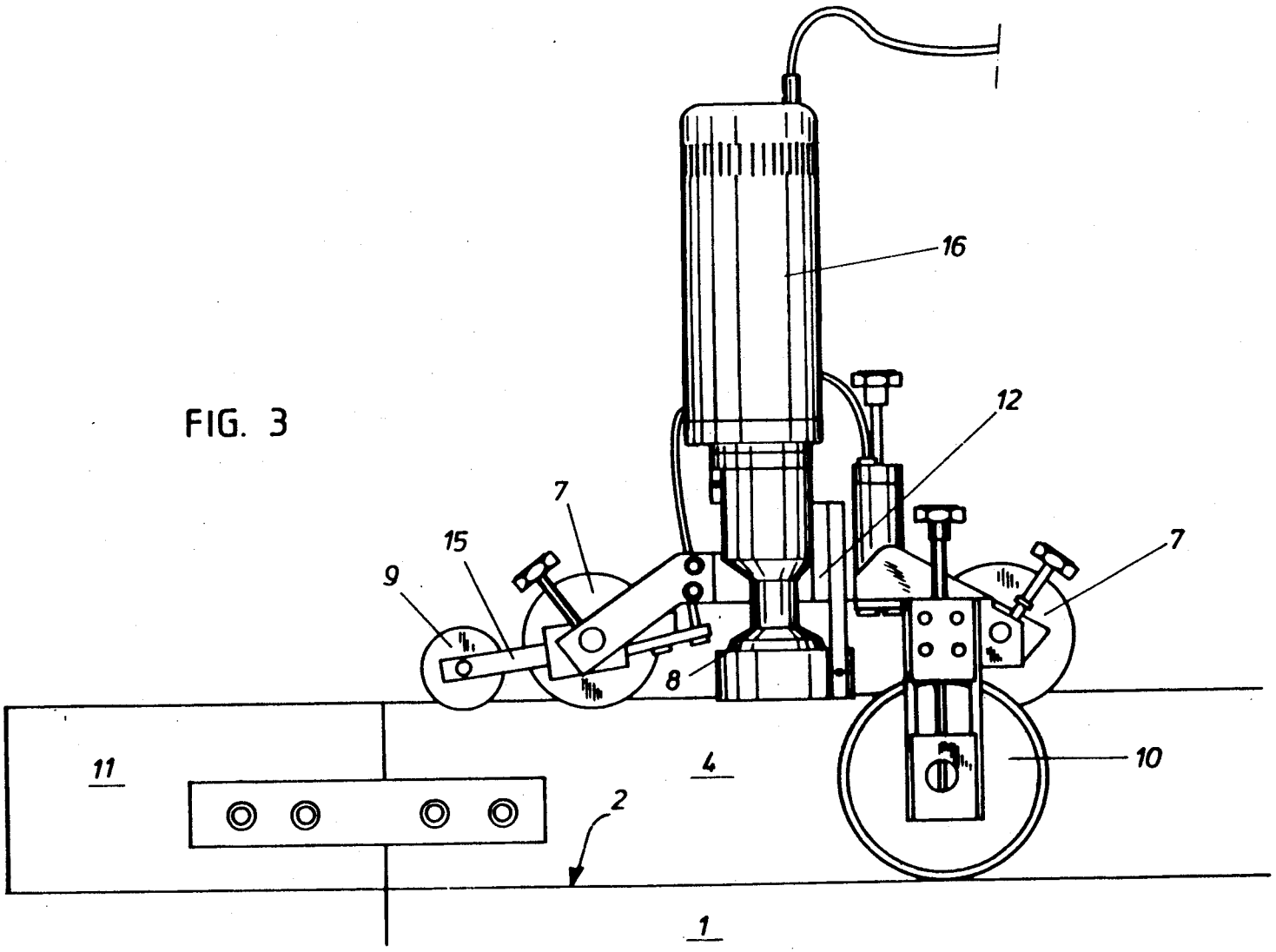
FIG. 3 is a side elevational view of the sharpening device.
Figure 4:
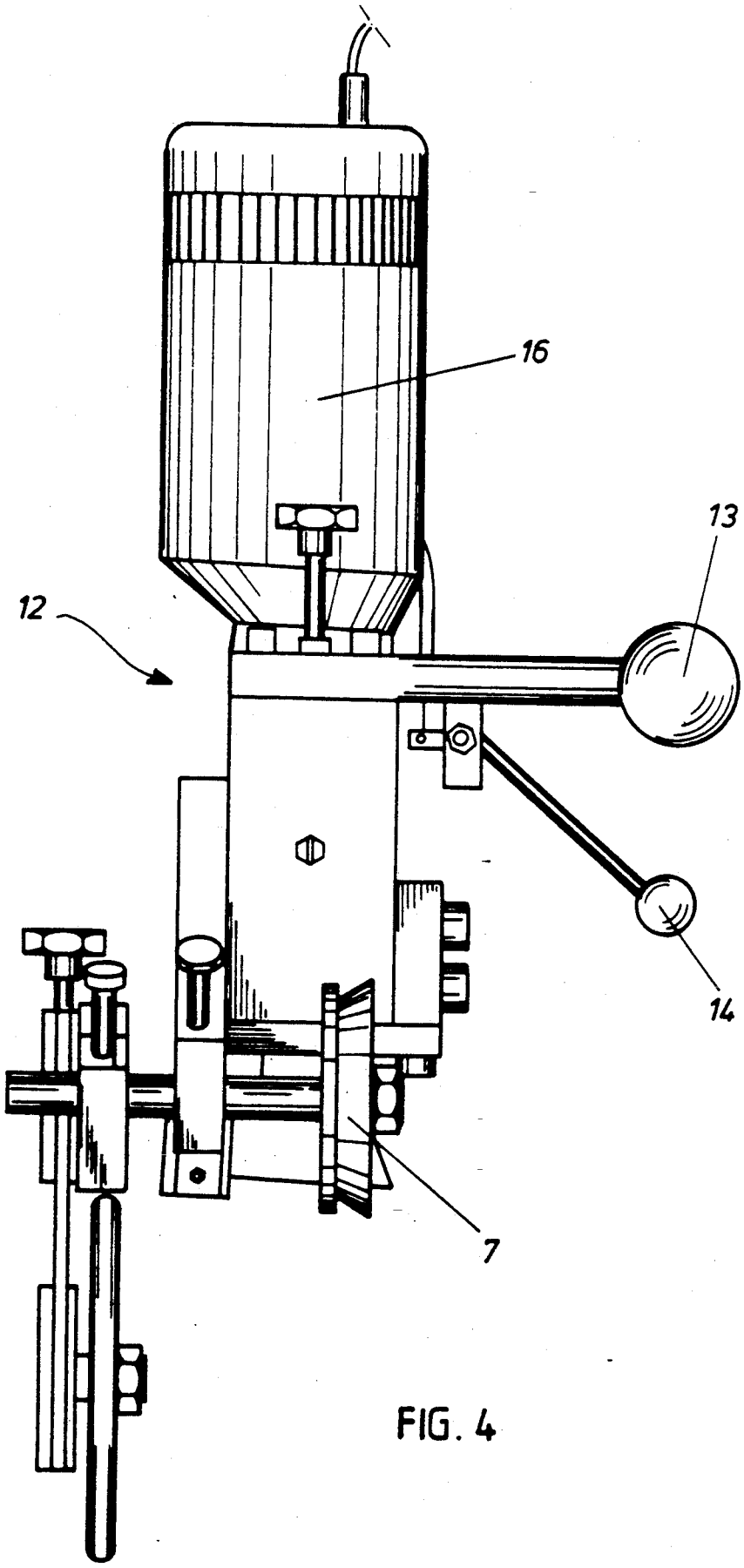
FIG. 4 is a plan view of the sharpening device seen from the direction of the blade plate.
Figure 5:
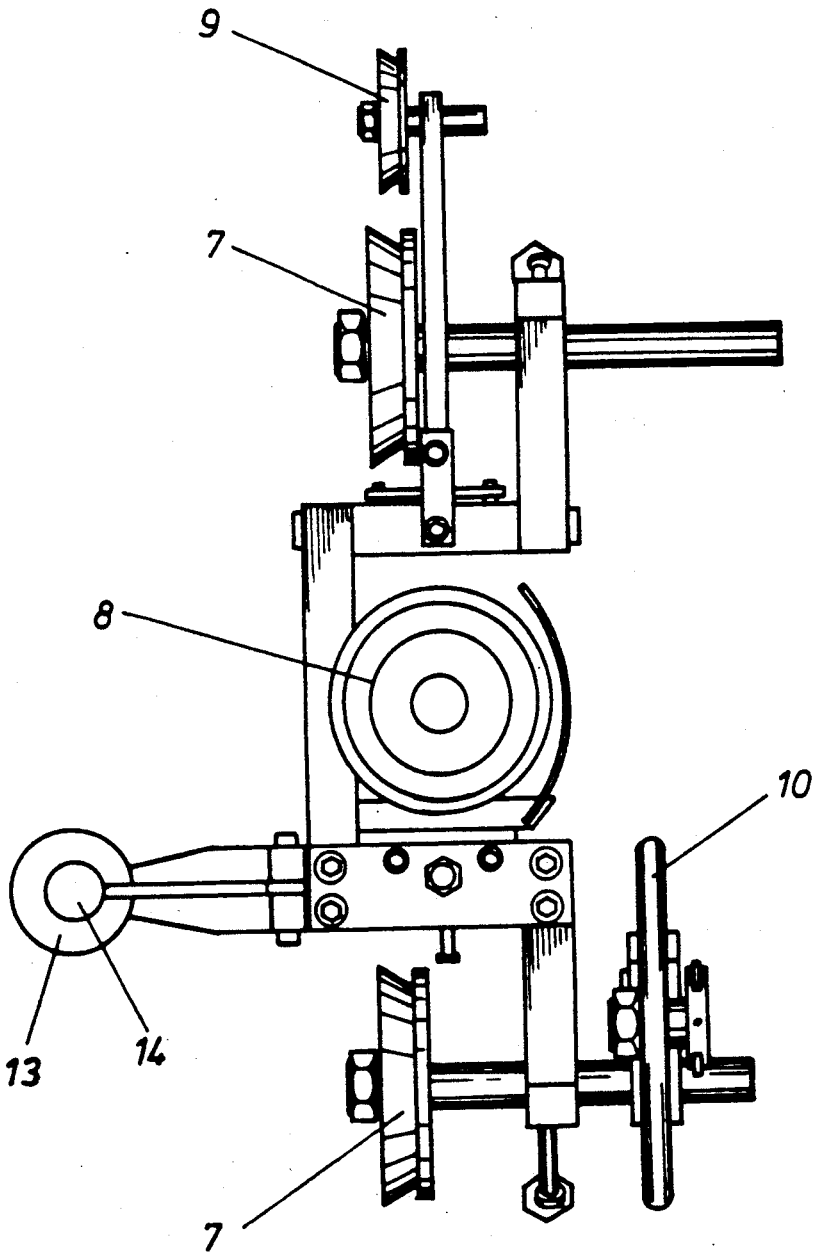
FIG. 5 is a view of the sharpening device seen from below.

The sharpening device includes a third auxiliary wheel 9 which is carried by the blade plate, this being attached to the frame 12 of the sharpening device by means of an arm, FIGS. 4 and 5. By means of a hand lever 14, it is possible to turn arm 15 using a cable arrangement, in which case the grinding stone rises slightly above the blade, FIGS. 3 and 4. After this, the electric motor 16 can be started and the grinding stone 8 is gradually lowered towards the blade surface. It is thus possible to ensure that the grinding stone 8 does not cut too much of the blade plate 4.

The sharpening device includes locating devices for each of the support wheels together with adjusting screws and locating devices for the electric motor, by means of which grinding stone 8 can be set to a desired angle and position in relation to the blade plate 4. In addition to the angle of the bevel, it is also possible to adjust which part of the blade is ground by grinding stone 8, when the desired grinding finish is obtained.

Extension piece 11 of the blade plate 4 is also part of the equipment of the device. This is attached to the end of the blade plate 4, FIG. 3, for the duration of the grinding operation. By means of this, the support wheels 7 and 9 of the sharpening device can run on top of it so that the grinding stone 8 itself can cover the entire length of the blade plate 4.

While the best mode for carrying out the invention has been described in detail, those familiar with the art to which this invention relates will recognize various alternative designs and embodiments for practicing the invention as defined by the following claims.

What is claimed is:

1. A sharpening device for a blade of a cross-cutting roller in which the cross-cutting roller includes at least one blade plate having a beveled edge, the blade plate being placed in the angle formed by a two machined surfaces of the cross-cutting roller in such a way that the original bevel of the beveled edge faces outwardly and away from the angle formed by the two machined surfaces and that the blade is sharpened by grinding a less steep edge bevel than the original bevel of the blade plate, and which sharpening device includes support wheels, a grinding stone and a motor to rotate it, characterized in that at least one support wheel is adapted to be supported both on the original bevel of the blade plate and also on the opposite side of the original bevel of the blade plate.

2. A sharpening device in accordance with claim 1 characterized in that the device includes two support wheels that are supported on the original bevel of the blade plate and a side support wheel that is supported on the other machined surface of the cross-cutting roller which support wheel travels at a slight distance from the blade plate.

3. A sharpening device in accordance with claim 1 characterized in that the device includes an auxiliary wheel that rests on the blade plate and a level apparatus for raising and lowering the grinding stone against the edge bevel of the blade plate.

4. A sharpening device in accordance with claim 1 characterized in that the device includes an extra blade to be added as an extension to the blade plate on which the sharpening device can run in order to let the grinding stone travel to the end of the blade plate properly.

5. A sharpening device in accordance with claim 1 characterized in that the support wheel includes integral, concentric disc portions, one disc portion having a peripheral edge tapering inwardly toward the other disc portion, said peripheral edge terminating in an acute angle formed by the peripheral edge and the radial edge of the other disc portion, the tapering peripheral edge being in engagement with the beveled edge with the blade plate and the radial edge being in engagement with the opposite side of the blade plate.

* * * * *